US009877115B2

(12) United States Patent
Giri et al.

(10) Patent No.: US 9,877,115 B2
(45) Date of Patent: Jan. 23, 2018

(54) DYNAMIC RELATIVE TRANSFER FUNCTION ESTIMATION USING STRUCTURED SPARSE BAYESIAN LEARNING

(71) Applicant: Starkey Laboratories, Inc., Eden Prairie, MN (US)

(72) Inventors: Ritwik Giri, Eden Prairie, MN (US); Frederic Philippe Denis Mustiere, Chaska, MN (US); Tao Zhang, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 15/274,709

(22) Filed: Sep. 23, 2016

(65) Prior Publication Data

US 2017/0094421 A1 Mar. 30, 2017

Related U.S. Application Data

(60) Provisional application No. 62/232,673, filed on Sep. 25, 2015.

(51) Int. Cl.
*H04R 25/00* (2006.01)
*G10L 25/78* (2013.01)

(52) U.S. Cl.
CPC ..... *H04R 25/407* (2013.01); *G10L 25/78* (2013.01); *H04R 25/505* (2013.01); *H04R 2430/25* (2013.01); *H04R 2460/01* (2013.01)

(58) Field of Classification Search
CPC ..... H04R 25/405; H04R 2225/43; H04R 2430/25
See application file for complete search history.

(56) References Cited

U.S. PATENT DOCUMENTS

| | | | | |
|---|---|---|---|---|
| 6,633,857 | B1 | 10/2003 | Tippping | |
| 8,208,647 | B2 | 6/2012 | Ahnert et al. | |
| 9,591,411 | B2 * | 3/2017 | Jensen | H04R 25/30 |
| 9,635,473 | B2 * | 4/2017 | Guo | H04R 25/405 |
| 9,723,422 | B2 * | 8/2017 | Jensen | H04R 29/005 |

(Continued)

OTHER PUBLICATIONS

Cohen, Israel, et al., "Real-time tf-gsc in nonstationary noise environment", Israel Institute of Technology, 2003, (Sep. 2003), 183-186.

(Continued)

*Primary Examiner* — Curtis Kuntz
*Assistant Examiner* — Ryan Robinson
(74) *Attorney, Agent, or Firm* — Schwegman Lundberg & Woessner, P.A.

(57) ABSTRACT

The use of a dynamic Relative Transfer Function (RTF) between two or more microphones may be used to improve multi-microphone speech processing applications. The dynamic RTF may improve speech intelligibility and speech quality in the presence of environmental changes, such as variations in head or body movements, variations in hearing device characteristics or wearing positions, or variations in room or environment acoustics. The use of an efficient and fast dynamic RTF estimation algorithm using short burst of noisy, reverberant mic recordings, which will be robust to head movements may provide more accurate RTFs which may lead to a significant performance increase.

20 Claims, 3 Drawing Sheets

(56) References Cited

U.S. PATENT DOCUMENTS

| | | | | |
|---|---|---|---|---|
| 9,747,917 | B2 * | 8/2017 | Tzirkel-Hancock | G10L 21/00 |
| 2010/0260364 | A1 * | 10/2010 | Merks | H04R 25/407 381/313 |
| 2012/0224498 | A1 | 9/2012 | Abrishamkar | |
| 2016/0112811 | A1 * | 4/2016 | Jensen | H04R 5/033 381/17 |
| 2016/0241974 | A1 * | 8/2016 | Jensen | H04R 25/407 |

OTHER PUBLICATIONS

Gannot, Sharon, et al., "Signal enhancement using beamforrning and nonstationarity with applications to speech", IEEE Transactions on Signal Processing, vol. 49, No. 8, (Aug. 8, 2001), 1614-1626.

Gannot, Sharon, et al., "Speech enhancement based on the general transfer funtion gsc and postfiltering", IEEE Transactions on Speech and Audio Processing, vol. 12, No. 6, (2004) 4 pgs.

Giri, Ritwik, et al., "Dynamic Relative Impulse Response Estimation Using Structured Sparse Bayesian Learning", (2016), 5 pgs.

Giri, Ritwik, et al., "Type i and type ii bayesian methods for sparse signal recovery using scale mixtures", arXiv preprint arXiv:1507.05087, (Jul. 17, 2015), 11 pgs.

Hadad, Elior, et al., "Multichannel audio database in various acoustic environments", 14th International Workshop on Acoustic Signal Enhancement (IWAENC), 2014. IEEE, 2014, (2014), 313-317.

Koldovsky, Zbynek, et al., "Noise reduction in dual-microphone mobile phones using a bank of pre-measured target-cancellation filters", IEEE Transactions on Audio, Speech, and Language Processing, vol. 17, No. 6,, (2013), 679-683.

Koldovsky, Zbynek, et al., "Spatial source subtraction based on incomplete measurrnents of relative transfer function", IEEE Transactions on Audio, Speech, and Language Processing, vol. 23, No. 8, (Apr. 20, 2015), 1-22.

Kreuger, Alexander, et al., "Speech enhancement with a gsc-like structure employing eigenvector-based transfer function ratios estimation", IEEE Transactions on Audio, Speech, and Language Processing , vol. 19, No. 1 (Jan. 2011), 206-219.

Laufer, Bracha, et al., "Relative transfer function modeling for supervised source localization", in IEEE Workshop on Applications of Signal Processing to Audio and Acoustics (WASPAA), 2013. IEEE, 2013, (Oct. 20, 2013), 4 pgs.

Lin, Yuanqing, et al., "Bayesian regularization and nonnegative deconvolution for room impulse response estimation", IEEE Transactions on Signal Processing, vol. 54, No. 3, 2006, (Mar. 2006), 839-847.

Lin, Yuanqing, et al., "Blind channel identification for speech dereverberation using I1-norm sparse learning", Advances in Neural Information Processing Systems, 2007, (2007), 1-8.

Malek, Jiri, et al., "Sparse target cancellation filters with application to semi-blind noise extraction", in IEEE International Conference on Acoustics, Speech and Signal Processing (ICASSP), 2014. IEEE, 2014, (2014), 2128-2132.

Markovich, Shmulik, et al., "Multichannel eigenspace beamforming in a reverberant noisy environment with multiple interfering speech signals", IEEE Transactions on Audio, Speech, and Language Processing, vol. 17, No. 6, (Aug. 2009), 1071-1086.

Marquardt, Donald W, et al., "Ridge regression in practice", The American Statistician, vol. 29, No. 1, (Feb. 1975), 19 pgs.

Ono, Nobutaka, et al., "The 2013 signal separation evaluation campaign", in IEEE International Workshop on Machine Learning for Signal Processing (MLSP), 2013. IEEE, 2013, (2013), 1-6.

Schwab, M, et al., "Noise robust relative transfer function estimation", in IEEE 14th European Signal Processing Conference, 2006., (2006), 5 pgs.

Talmon, Ronen, et al., "Relative transfer function identification using convolutive transfer function approximation", IEEE Transactions on Audio, Speech, and Language Processing, vol. 17, No. 4, (2008), 1-20.

Tipping, Michael E, "Sparse bayesian learning and the relevance vector machine", The journal of machine learning research, vol. 1, 2001, (2001), 34 pgs.

Wipf, David, et al., "Iterative reweighted 1 and 2 methods for finding sparse solutions", IEEE Journal of Selected Topics in Signal Processing, vol. 4, No. 2, 2010., (Jan. 13, 2010), 1-29.

Wipf, David P, et al., "Sparse bayesian learning for basis selection", IEEE Transactions on Signal Processing, vol. 52, No. 8 (Aug. 2004), 2153-2164.

Woods, William S, et al., "A real-world recording database for ad hoc microphone arrays", in Workshop on Applications of Signal Processing to Audio and Acoustics (WASPAA). IEEE, 2015, (Oct. 2015), 5 pgs.

* cited by examiner

DYNAMIC RELATIVE TRANSFER FUNCTION ESTIMATION USING STRUCTURED SPARSE BAYESIAN LEARNING

CLAIM OF PRIORITY

This patent application claims the benefit of priority of U.S. Provisional Patent Application Ser. No. 62/232,673, titled "DYNAMIC RELATIVE TRANSFER FUNCTION ESTIMATION USING STRUCTURED SPARSE BAYESIAN LEARNING," filed on Sep. 25, 2015, which is hereby incorporated by reference herein in its entirety.

TECHNICAL FIELD

Embodiments described herein generally relate to noise reduction in hearing devices.

BACKGROUND

An audio relationship between two or more microphones may be used in multi-microphone speech processing applications, such as hearing devices (e.g., headphones, hearing assistance devices). In processing audio signals from two or more sources, some existing beamformers are designed based on simple geometric considerations based on assumptions about the relationship between audio sources. For example, some existing solutions assume that a target speaker is located directly to the front of a hearing device, and assume that the speech signal received is identical at the two microphones on each side of the hearing device. The assumptions made by existing solutions do not adapt to movement, to external noise interference, or other changes in the acoustic environment. It is desirable to improve multi-microphone speech processing.

DESCRIPTION OF EMBODIMENTS

The use of a dynamic Relative Transfer Function (RTF) between two or more microphones may be useful in multi-microphone speech processing applications. The dynamic RTF may improve speech intelligibility and speech quality in the presence of environmental changes, such as variations in head or body movements, variations in hearing device characteristics or wearing positions, or variations in room or environment acoustics. The use of an efficient and fast dynamic RTF estimation algorithm using short burst of noisy, reverberant mic recordings, which will be robust to head movements (e.g., microphone positions) may provide more accurate RTFs which may lead to a significant performance increase.

Issues with frequency resolution (e.g., number of frequency bands) may be reduced or eliminated by working within a time domain. However, a traditional Time Domain least square approach may produce ineffective and unstable estimates due to the presence of noise and a finite amount of samples in the deconvolution problem. A dynamic Regularized Least Squares approach where the regularization has been incorporated by exploiting a model for the prior structure of a relative impulse response may increase the effectiveness and the stability over the traditional Time Domain least square approach. Specifically, by using unified treatment of sparse early reflection and exponential decaying reverberation in a prior distribution using a hierarchical Bayesian framework, a more accurate estimate of relative impulse response may be observed over traditional Time Domain least squares. In addition, the solution may use only 100-200 ms of recording, which may make it a more robust approach for dealing with nonstationarity of RTF, such as by reducing or eliminating inaccuracies caused by head movements of the hearing aid user, movement of the target, etc.

This description of embodiments of the present subject matter refers to subject matter in the accompanying drawings, which show, by way of illustration, specific aspects and embodiments in which the present subject matter may be practiced. These embodiments are described in sufficient detail to enable those skilled in the art to practice the present subject matter. References to "an," "one," or "various" embodiments in this disclosure are not necessarily to the same embodiment, and such references contemplate more than one embodiment. The above detailed description is demonstrative and not to be taken in a limiting sense. The scope of the present subject matter is defined by the appended claims, along with the full scope of legal equivalents to which such claims are entitled.

Figure 1:
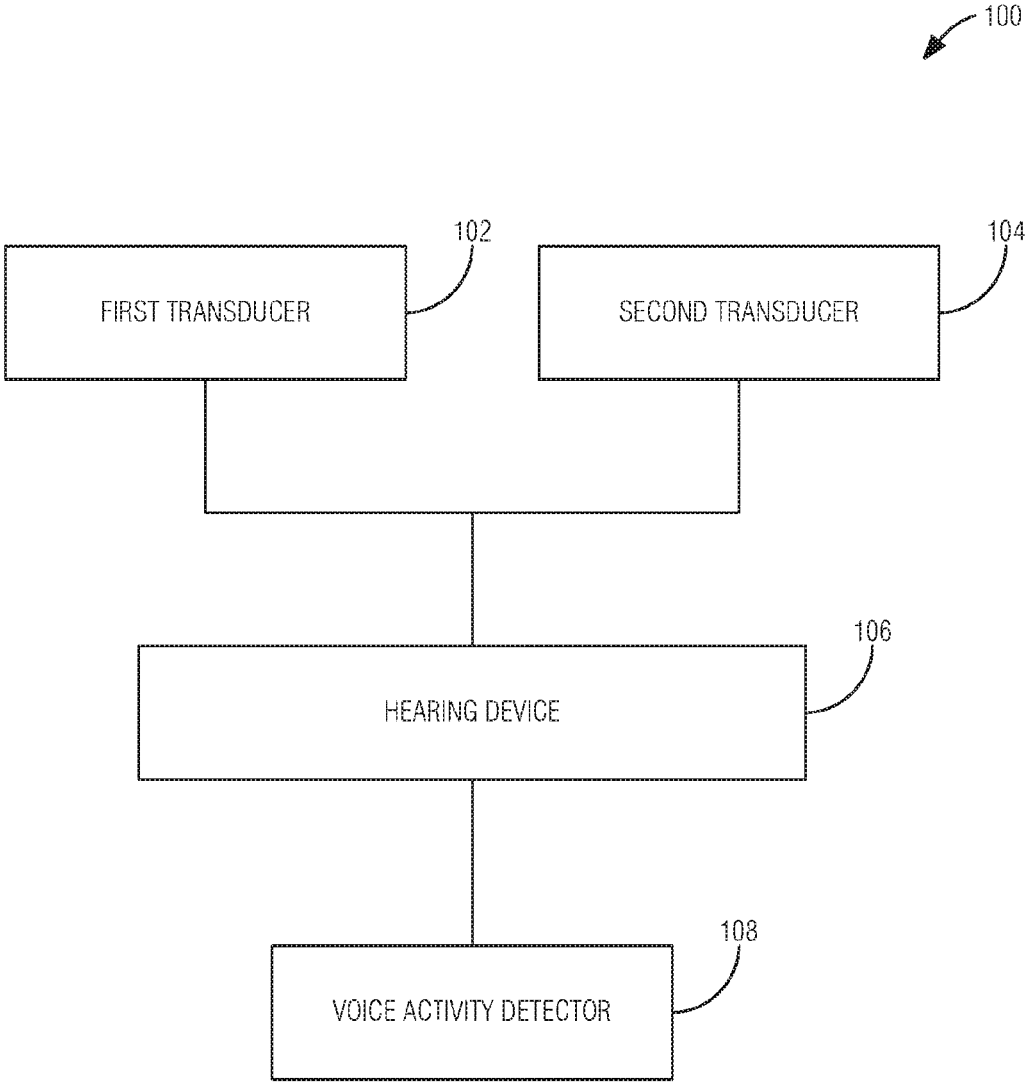
FIG. 1 is a block diagram of a noise reduction system, in accordance with at least one embodiment of the invention.

FIG. 1 is a block diagram of a noise reduction system 100, in accordance with at least one embodiment of the invention. System 100 includes a first transducer 102 and a second transducer 104, where each transducer converts an audio source into an audio signal. In an embodiment, the audio signals are between 100 ms and 200 ms in duration. System 100 includes a hearing device 106, which receives the audio signals from the transducers 102 and 104. Hearing device 106 may include transducers 102 and 104 within a common housing, such as two microphones within a pair of hearing aids or within a set of headphones. Hearing device 106 uses the received audio signals to determine an estimated Relative Transfer Function (RTF). To determine the RTF, the hearing device 106 iteratively determines a Relative Impulse Response (ReIR) point estimate until the ReIR point estimate converges, and then estimates the RTF based on the converged ReIR point estimate. The ReIR is determined using a hierarchical Bayesian framework, where the Bayesian framework includes a unified treatment of sparse early reflection and an exponential decaying reverberation in a prior distribution, referred to herein as Structured Sparse Bayesian Learning (S-SBL). The use of this S-SBL includes updating a plurality of prior Bayesian distribution parameters based on application of Expectation-Maximization (EM) to the reverberation tail and the estimated RTF. In various embodiments, the S-SBL algorithm may be resistant to packet drops or missing audio. In an embodiment, the latest RTF estimate may be used in response to a packet drop or missing audio. In an example, the estimate may be updated once the streaming resumes.

Hearing device 106 then uses RTF to determine a target signal, generate a noise reference, and then cancel the target signal to produce a noise signal. In an embodiment, canceling the target signal is performed by beamforming using an adaptive Generalized Sidelobe Canceler (GSC), where the blocking matrix of the adaptive GSC is designed using the RTF. Finally, the noise signal is used for audio beamforming (e.g., adaptive interference cancellation, post filtering) to improve the speech enhancement performance.

System 100 may include a voice activity detector (VAD) 108. The VAD 108 may improve the RTF determination by providing an additional audio signal. For example, VAD 108 may include a microphone (e.g., a smartphone) placed between a user and a target audio source. The VAD 108 may improve RTF estimation, such as in environments that include high background noise levels or with audio sources that project laterally instead of toward the user.

In an embodiment, one or more of the components of system 100 may be resident on a mobile electronic device (e.g., a smartphone). In another embodiment, the hearing device may operate in conjunction with a connected smartphone. In an example, the hearing device signals may be synchronized and streamed to the smartphone, which may then process the signals to estimate the RTF. The RTF may then be transmitted back to the hearing device, which may perform the beamforming locally. The actual audio signal at the receiver may not be directly affected by a wireless transmission delay between the smartphone and the hearing device because the most recent RTF estimate may only be delayed by the total transmission delay and the length of the collected data.

Figure 2:
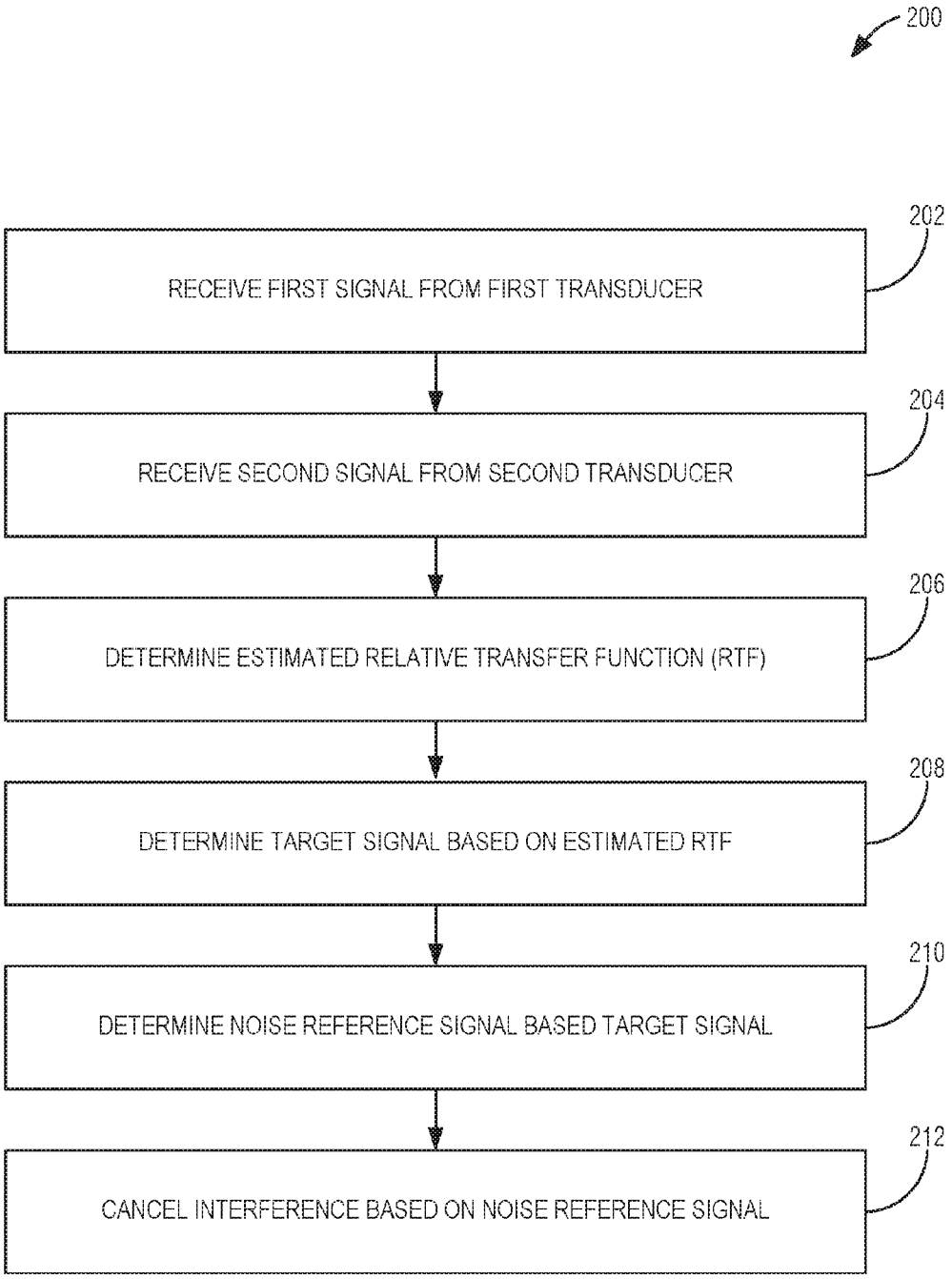
FIG. 2 is a block diagram of a noise reduction method, in accordance with at least one embodiment of the invention.

FIG. 2 is a block diagram of a noise reduction method 200, in accordance with at least one embodiment of the invention. Method 200 includes receiving a first signal from a first transducer 202 and receiving a second signal from a second transducer 204. Method 200 then determines an estimated RTF 206, where the RTF is determined based upon the first signal and the second signal using a hierarchical Bayesian framework. Determining the RTF 206 includes iteratively determining a ReIR point estimate until the ReIR point estimate converges, and then estimating the RTF based on the converted ReIR point estimate.

Determining the RTF 206 is based on the S-SBL that includes a unified treatment of sparse early reflection and an exponential decaying reverberation in a prior distribution. In an embodiment, the first and second signals are received from a target in a diffuse noise environment, where the target position is fixed for a certain time interval. This situation can be represented as:

$$x_L[n]=(h_L*s)[n]+\epsilon_L[n] \tag{1}$$

$$x_R[n]=(h_R*s)[n]+\epsilon_R[n]\approx(h_{rel}*x_L)[n]+\epsilon_R[n] \tag{2}$$

Where $h_L$ and $h_R$ denote the impulse response between the target and the two microphones, s[n] denotes the target speech, $\epsilon_L[n]$ and $\epsilon_R[n]$ denote the noise components. The main problem is to estimate $h_{rel}$, which denotes the ReIR between the left and right microphone. The solution of this problem in the time domain is $h_{rel}=h_R*h_L^{-1}$. To ensure that the solution is causal, a fixed delay of a few milliseconds can be introduced, i.e., $h_{rel}=h_R*h_L^{-1}*\delta(n-d)$ where d is the delay in samples. The RTF, denoted as $H_{RTF}$, which is the Fourier Transform of $h_{rel}$, can also be written as $$H_{RTF}(\theta)=\frac{H_R(\theta)}{H_L(\theta)}.$$

In presence of noise, method 200 uses this S-SBL regularization strategy to stabilize the LS solution. The S-SBL regularization strategy in method 200 incorporates the structure information of ReIRs as a prior in a Bayesian framework. In particular, S-SBL considers both the sparse early reflections and the reverberation tail in a unified framework. Moreover, the S-SBL does not require a priori knowledge of SNR because the noise variance is also estimated within the proposed framework.

Using the model $x_R=X_Lh+\epsilon$, along with the Gaussian Likelihood assumption $p(x_R|h)\sim N(X_Lh,\sigma^2)$, the prior distribution over h is as follows:

$$p(h|\gamma_p,c_1,c_2)\sim N(0,\Gamma) \tag{3}$$

with $$\Gamma=\mathrm{diag}[\gamma_1,\ldots,\gamma_p,c_1e^{-c_2},\ldots,c_1e^{-c_2m},\ldots,c_1e^{-c_2M}] \tag{4}$$

where $\gamma_p$ corresponds to $p^{th}$ early reflection, and where $c_1e^{-c_2m}$ corresponds to the $m^{th}$ tap out of the M exponentially decaying reverberation tail components. In this variant of SBL, S-SBL has also incorporated the reverberation tail regularization by tying the last M diagonal elements of Γ in an exponentially decaying tail.

S-SBL follows a Type II likelihood/Evidence maximization procedure to estimate the ReIR. For estimating h, method 200 computes the posterior as:

$$p(h|x_r,\gamma,c_1,c_2)=N(h;\mu,\Sigma) \tag{5}$$

where $$\mu=\sigma^{-2}\Sigma X_L^Tx_R \tag{6}$$

$$\Sigma=(\sigma^{-2}X_L^TX_L+\Gamma^{-1})^{-1} \tag{7}$$

This approximates the true posterior by a Gaussian distribution whose mean and covariance depends on the estimated hyperparameters. $\hat{h}=\mu$ is the point estimate of the relative impulse response. An evidence maximization approach is used to estimate the hyperparameters:

$$\hat{\Gamma},\hat{c}_1,\hat{c}_2=arg\max p(x_R|\gamma_1,c_1,c_2) \tag{8}$$

Method 200 applies Expectation-Maximization (EM) to solve the above optimization. The use of EM is possible because of the monotonic convergence property of the optimization. In an example, method 200 may use EM in response to detecting a monotonicity property. To estimate the previously discussed hyperparameters, the ReIR h is treated as a hidden variable. In the E step, for iteration t, method 200 computes the following conditional expectation for all taps i $\epsilon\{1,\ldots,P+M\}$:

$$\langle h_i^2\rangle=E_{h|x_R;\gamma^t,c_1^t,c_2^t,\sigma^2}[h_i^2]=\Sigma_{(i,i)}+\mu_i^2 \tag{9}$$

where $\Sigma_{(i,i)}$ is the $i^{th}$ diagonal element of Σ. The E step is used to compute the Q-function:

$$Q(\gamma,c_1c_2,\sigma^2)=E_{h|x_R;\gamma^t,c_1^t,c_2^t,\sigma^2}[\log(p(x_R|h;\sigma^2)p(h|\gamma,c_1,c_2))] \tag{10}$$

In the M step, maximizing this Q-function with respect to the hyperparameters i.e., γ, $c_1$, $c_2$, and $\sigma^2$ provides:

$$\gamma_p=\sum_{(p,p)}+\mu_p^2 \text{ for } p=1\ldots P \tag{11}$$

$$c_1=\frac{1}{M}\sum_{m=1}^{M}e^{c_2m}\langle h_{m+P}^2\rangle \tag{12}$$

$$\sum_{m=1}^{M}me^{c_2m}\langle h_{m+P}^2\rangle-c_1\frac{M(M+1)}{2}=0 \tag{13}$$

-continued $$\sigma^2 = \frac{\|x_R - X_L h\|^2}{N - (M + P) + \sum_{i=1}^{M+P} \sum_{(i,i)} / \Gamma_i} \tag{14}$$

In Equation (12), the estimate of $c_2$ is used from the previous iteration. The solution of Equation (13) provides the closed form update rule of $c_2$. Representing it as a polynomial of $\hat{v}=e^{c_2}$, Descartes' sign rule indicates that there is only one positive root $\hat{V}$ of (13). Therefore $c_2$ is updated using $c_2=\log \hat{v}$. Hence, every iteration updates all the hyperparameters using the update rules shown above, and the point estimate $\hat{h}$ is computed by substituting the updated hyperparameters in Equation (6). In the subsequent iteration, method 200 updates $\mu$ and $\Sigma$ to recompute all the hyperparameters. In practice, 10 to 15 iterations of the above S-SBL procedure yields a converged relative impulse response estimate h.

Following determination of the RTF 208, method 200 uses the RTF to determine a target signal. Method 200 then determines a noise reference signal based on the first and second signal, and based on cancellation of the target signal. In an embodiment, canceling the target signal is performed using an adaptive GSC, where the blocking matrix of the adaptive GSC is designed using the RTF. Method 200 includes cancelling interference based on the noise reference signal 212 to improve the speech enhancement performance.

The S-SBL framework provides various improvements over alternative approaches. Table 1 shows the SNR Gain of a Generalized Sidelobe Canceller (GSC) beamformer using S-SBL framework (e.g., using a "true" RTF compared to a GSC using "naïve" RTF assumption) in a situation where a reverberant interfering talker and diffuse white noise are present in the listening environment with input SNR=0 dB.

TABLE 1

S-SBL GSC vs. GSC with naïve RTF

| Algorithms | SNR Gain |
|---|---|
| GSC with true RTF + Post Filter | 9.32 dB |
| GSC with naïve RTF + Post Filter | 1.61 dB |

In the following example, the S-SBL solution used in method 200 is compared to a non-stationarity based frequency domain estimator (NSFD) solution, using an experimental setup providing simulation results. The S-SBL and the NSFD have access to the same information and binaural signals recorded at the two microphones. In the example, the simulation uses the Experimental Setting and publicly available recordings. Table 2 illustrates the experimental conditions details.

TABLE 2

Experimental Conditions Details

| Parameter | Value |
|---|---|
| Sampling Frequency | 8 kHz |
| Input SNR | 0 dB |
| Target Angle | 0 degree |
| Directional Noise Angle | −60 degree |
| Microphone pair | [3 4] (3 cm) |
| Distance of Sources to Mic | 2 m |
| T60 | 360 |

In Table 3 below, simulation results are provided using NSFD and S-SBL using 125 ms of recording and averaging over 50 segments where target speech is present. Two noisy conditions at 0 dB have been tested, namely: with omnidirectional babble noise and directional speaking interferer where the angular separation between noise source and target source is 60 degree. For a speaking interferer, the solution assumes that the target voice activity detector is available to both the algorithms.

The performance has been measured in terms of target signal blocking ability using a signal blocking factor (SBF) metric. The SBF score may be directly relatable to GSC beamforming performance since a GSC structure may have a signal blocking branch in which the target signal may be cancelled to generate a noise reference estimate. The less effective the blocking capability of a GSC blocking branch, the more likely it is that some speech components will pass through, which may then result in target cancellation in the later stage of the GSC.

TABLE 3

SBF Target Blocking Performance vs. S-SBL

| Algorithm | SBF for Omnidirectional Babble Noise | SBF for Directional Speaking Interferer |
|---|---|---|
| NSFD | 14.94 dB | 20.97 dB |
| S-SBL | 17.89 dB | 25.95 dB |

As can be seen in Table 3, the S-SBL solution consistently outperforms the NSFD solution, even when using different signals from different databases.

In various embodiments, the S-SBL algorithm may include O(M^3) where M is the length of relative impulse response. This may be optimized for use in a hearing device. In some example embodiments, the calculations may be performed by a separate computing device (e.g., a smartphone or other personal digital device) communicatively coupled to the hearing device (e.g., via a wireless network).

Figure 3:
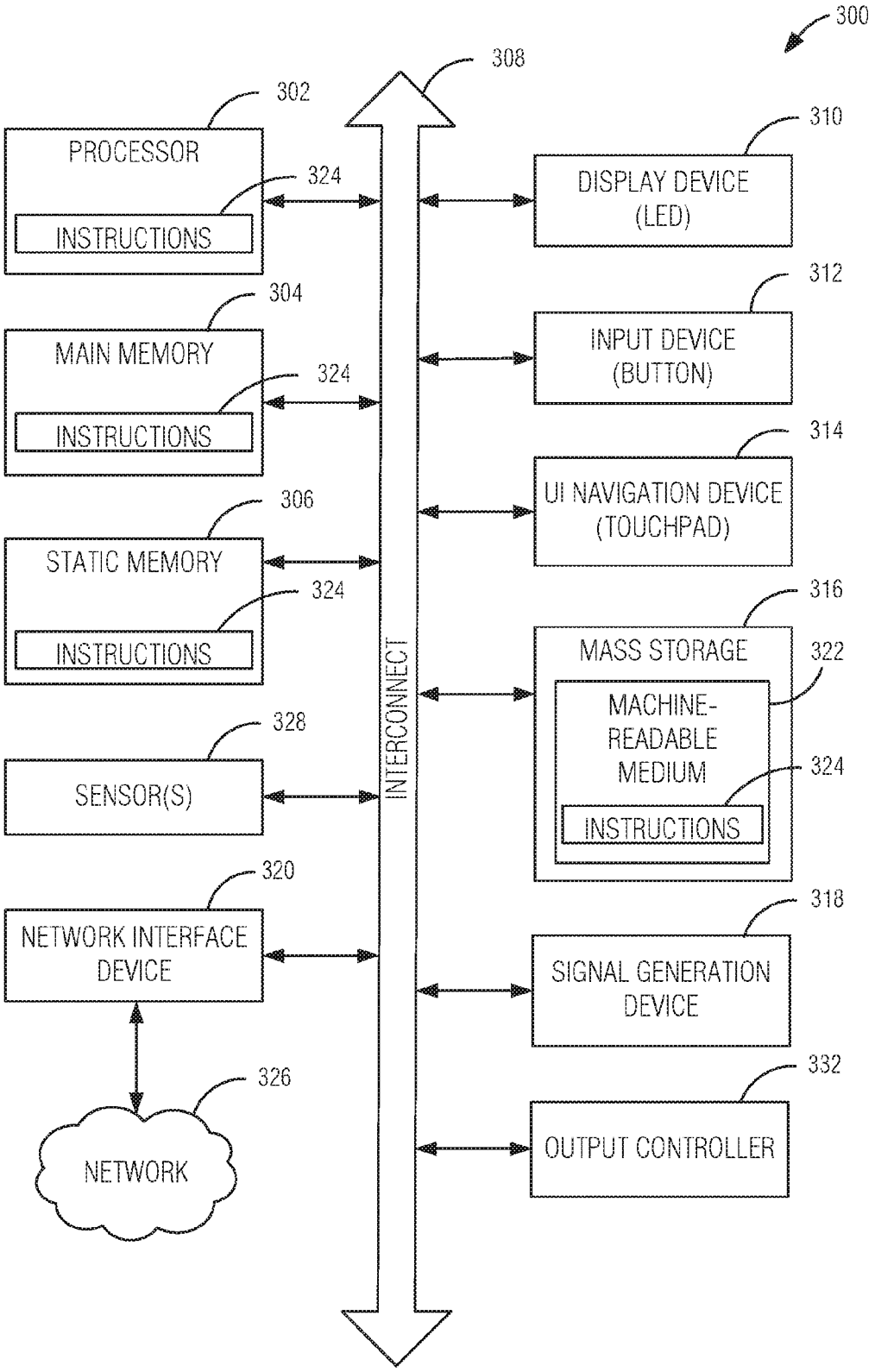
FIG. 3 illustrates a block diagram of an example machine upon which any one or more of the techniques discussed herein may perform.

FIG. 3 illustrates a block diagram of an example machine 300 upon which any one or more of the techniques (e.g., methodologies) discussed herein may perform. In alternative embodiments, the machine 300 may operate as a standalone device or may be connected (e.g., networked) to other machines. In a networked deployment, the machine 300 may operate in the capacity of a server machine, a client machine, or both in server-client network environments. In an example, the machine 300 may act as a peer machine in peer-to-peer (P2P) (or other distributed) network environment. The machine 300 may be a personal computer (PC), a tablet PC, a set-top box (STB), a personal digital assistant (PDA), a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

Examples, as described herein, may include, or may operate by, logic or a number of components, or mechanisms. Circuit sets are a collection of circuits implemented in tangible entities that include hardware (e.g., simple circuits, gates, logic, etc.). Circuit set membership may be flexible over time and underlying hardware variability. Circuit sets include members that may, alone or in combination, perform specified operations when operating. In an example, hardware of the circuit set may be immutably designed to carry out a specific operation (e.g., hardwired). In an example, the hardware of the circuit set may include variably connected physical components (e.g., execution units, transistors, simple circuits, etc.) including a computer readable medium physically modified (e.g., magnetically, electrically, moveable placement of invariant massed particles, etc.) to encode instructions of the specific operation. In connecting the physical components, the underlying electrical properties of a hardware constituent are changed, for example, from an insulator to a conductor or vice versa. The instructions enable embedded hardware (e.g., the execution units or a loading mechanism) to create members of the circuit set in hardware via the variable connections to carry out portions of the specific operation when in operation. Accordingly, the computer readable medium is communicatively coupled to the other components of the circuit set member when the device is operating. In an example, any of the physical components may be used in more than one member of more than one circuit set. For example, under operation, execution units may be used in a first circuit of a first circuit set at one point in time and reused by a second circuit in the first circuit set, or by a third circuit in a second circuit set at a different time.

Machine (e.g., computer system) 300 may include a hardware processor 302 (e.g., a central processing unit (CPU), a graphics processing unit (GPU), a hardware processor core, or any combination thereof), a main memory 304 and a static memory 306, some or all of which may communicate with each other via an interlink (e.g., bus) 308. The machine 300 may further include a display unit 310, an alphanumeric input device 312 (e.g., a keyboard), and a user interface (UI) navigation device 314 (e.g., a mouse). In an example, the display unit 310, input device 312 and UI navigation device 314 may be a touch screen display. The machine 300 may additionally include a storage device (e.g., drive unit) 316, a signal generation device 318 (e.g., a speaker), a network interface device 320, and one or more sensors 321, such as a global positioning system (GPS) sensor, compass, accelerometer, or other sensor. The machine 300 may include an output controller 328, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

The storage device 316 may include a machine readable medium 322 on which is stored one or more sets of data structures or instructions 324 (e.g., software) embodying or utilized by any one or more of the techniques or functions described herein. The instructions 324 may also reside, completely or at least partially, within the main memory 304, within static memory 306, or within the hardware processor 302 during execution thereof by the machine 300. In an example, one or any combination of the hardware processor 302, the main memory 304, the static memory 306, or the storage device 316 may constitute machine readable media.

While the machine readable medium 322 is illustrated as a single medium, the term "machine readable medium" may include a single medium or multiple media (e.g., a centralized or distributed database, and/or associated caches and servers) configured to store the one or more instructions 324.

The term "machine readable medium" may include any medium that is capable of storing, encoding, or carrying instructions for execution by the machine 300 and that cause the machine 300 to perform any one or more of the techniques of the present disclosure, or that is capable of storing, encoding or carrying data structures used by or associated with such instructions. Non-limiting machine readable medium examples may include solid-state memories, and optical and magnetic media. In an example, a massed machine readable medium comprises a machine readable medium with a plurality of particles having invariant (e.g., rest) mass. Accordingly, massed machine-readable media are not transitory propagating signals. Specific examples of massed machine readable media may include: nonvolatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 324 may further be transmitted or received over a communications network 326 using a transmission medium via the network interface device 320 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, peer-to-peer (P2P) networks, among others. In an example, the network interface device 320 may include one or more physical jacks (e.g., Ethernet, coaxial, or phone jacks) or one or more antennas to connect to the communications network 326. In an example, the network interface device 320 may include a plurality of antennas to communicate wirelessly using at least one of single-input multiple-output (SIMO), multiple-input multiple-output (MIMO), or multiple-input single-output (MISO) techniques. The term "transmission medium" shall be taken to include any intangible medium that is capable of storing, encoding, or carrying instructions for execution by the machine 300, and includes digital or analog communications signals or other intangible medium to facilitate communication of such software.

Various embodiments of the present subject matter may include a hearing assistance device. Hearing assistance devices typically include at least one enclosure or housing, a microphone, hearing assistance device electronics including processing electronics, and a speaker or "receiver." Hearing assistance devices may include a power source, such as a battery. In various embodiments, the battery may be rechargeable. In various embodiments multiple energy sources may be employed. It is understood that in various embodiments the microphone is optional. It is understood that in various embodiments the receiver is optional. It is understood that variations in communications protocols, antenna configurations, and combinations of components may be employed without departing from the scope of the present subject matter. Antenna configurations may vary and may be included within an enclosure for the electronics or be external to an enclosure for the electronics. Thus, the examples set forth herein are intended to be demonstrative and not a limiting or exhaustive depiction of variations.

It is understood that digital hearing aids include a processor. In digital hearing aids with a processor, programmable gains may be employed to adjust the hearing aid output to a wearer's particular hearing impairment. The processor may be a digital signal processor (DSP), microprocessor, microcontroller, other digital logic, or combinations thereof. The processing may be done by a single processor, or may be distributed over different devices. The processing of signals referenced in this application can be performed using the processor or over different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various embodiments the processor is adapted to perform instructions stored in one or more memories, which may or may not be explicitly shown. Various types of memory may be used, including volatile and nonvolatile forms of memory. In various embodiments, the processor or other processing devices execute instructions to perform a number of signal processing tasks. Such embodiments may include analog components in communication with the processor to perform signal processing tasks, such as sound reception by a microphone, or playing of sound using a receiver (i.e., in applications where such transducers are used). In various embodiments, different realizations of the block diagrams, circuits, and processes set forth herein can be created by one of skill in the art without departing from the scope of the present subject matter.

Various embodiments of the present subject matter support wireless communications with a hearing assistance device. In various embodiments, the wireless communications can include standard or nonstandard communications. Some examples of standard wireless communications include, but not limited to, Bluetooth™, low energy Bluetooth, IEEE 802.11 (wireless LANs), 802.15 (WPANs), and 802.16 (WiMAX). Cellular communications may include, but not limited to, CDMA, GSM, ZigBee, and ultra-wideband (UWB) technologies. In various embodiments, the communications are radio frequency communications. In various embodiments, the communications are optical communications, such as infrared communications. In various embodiments, the communications are inductive communications. In various embodiments, the communications are ultrasound communications. Although embodiments of the present system may be demonstrated as radio communication systems, it is possible that other forms of wireless communications can be used. It is understood that past and present standards can be used. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, ATM, Fiber-channel, Firewire or 1394, InfiniBand, or a native streaming interface. In various embodiments, such connections include all past and present link protocols. It is also contemplated that future versions of these protocols and new protocols may be employed without departing from the scope of the present subject matter.

In various embodiments, the present subject matter is used in hearing assistance devices that are configured to communicate with mobile phones. In such embodiments, the hearing assistance device may be operable to perform one or more of the following: answer incoming calls, hang up on calls, and/or provide two-way telephone communications. In various embodiments, the present subject matter is used in hearing assistance devices configured to communicate with packet-based devices. In various embodiments, the present subject matter includes hearing assistance devices configured to communicate with streaming audio devices. In various embodiments, the present subject matter includes hearing assistance devices configured to communicate with Wi-Fi devices. In various embodiments, the present subject matter includes hearing assistance devices capable of being controlled by remote control devices.

It is further understood that different hearing assistance devices may embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter may be employed in hearing assistance devices, such as headsets, hearing aids, headphones, and similar hearing devices.

The present subject matter may be employed in hearing assistance devices having additional sensors. Such sensors include, but are not limited to, magnetic field sensors, telecoils, temperature sensors, accelerometers, and proximity sensors.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard fitted, open fitted and/or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing device for processing signals, the system comprising:

a first transducer to transduce a first audio source into a first signal;

a second transducer to transduce a first audio source into a second signal; and a processor configured to execute instructions to:

determine an estimated Relative Transfer Function (RTF) based on the first signal and the second signal using a hierarchical Bayesian framework;

determine a target signal based on the estimated RTF; and generate a noise reference signal based on the first signal, the second signal, and a cancellation of the target signal.

2. The hearing device of claim 1, wherein the hearing device includes a hearing assistance device.

3. The hearing device of claim 1, wherein the hierarchical Bayesian framework includes a unified treatment of sparse early reflection and an exponential decaying reverberation in a prior distribution.

4. The hearing device of claim 1, wherein the processor is further configured to execute instructions to:

iteratively determine a Relative Impulse Response (ReIR) point estimate until the ReIR point estimate converges; and determine, in response to ReIR point estimate converging, the estimated RTF based on the ReIR.

5. The hearing device of claim 4, wherein the processor is further configured to execute instructions to update a plurality of prior Bayesian distribution parameters based on application of Expectation-Maximization (EM) to the reverberation tail and the estimated RTF.

6. The hearing device of claim 1, wherein:

the first signal includes a first dataset of a first duration;

the second signal includes a second dataset of a second duration; and the first duration is substantially similar to the second duration.

7. The hearing device of claim 6, wherein the first duration is less than 200 milliseconds and greater than 100 milliseconds.

8. The hearing device of claim 1, further including a communication device to receive a voice activity detection input based on a Voice Activity Detector (VAD), wherein determining the estimated RTF is further based on the voice activity detection input.

9. The hearing device of claim 1, wherein determining a noise reference signal based on the cancellation of the target signal includes cancelling the target signal based a blocking matrix of an adaptive Generalized Sidelobe Canceler, the blocking matrix designed using the RTF.

10. A method for processing signals, the method comprising:

receiving a first signal from a first transducer of a hearing device;

receiving a second signal from a second transducer;

determining an estimated Relative Transfer Function (RTF) based upon the first signal and the second signal using a hierarchical Bayesian framework;

determining a target signal based on the estimated RTF;

determining a noise reference signal based on the first signal, the second signal, and a cancellation of the target signal; and cancelling interference based on the noise reference signal.

11. The method of claim 10, wherein the hearing device includes a hearing assistance device.

12. The method of claim 10, wherein a unified treatment of sparse early reflection and an exponential decaying reverberation in a prior distribution is incorporated into the hierarchical Bayesian framework.

13. The method of claim 10, wherein determining the estimated RTF includes:

iteratively determining a Relative Impulse Response (ReIR) point estimate until the ReIR point estimate converges; and determining, in response to ReIR point estimate converging, the estimated RTF based on the ReIR.

14. The method of claim 13, wherein iteratively determining the ReIR point estimate includes interactively updating a plurality of prior Bayesian distribution parameters based on application of Expectation-Maximization (EM) to the reverberation tail and the estimated RTF.

15. The method of claim 10, wherein:

the first signal includes a first dataset of a first duration;

the second signal includes a second dataset of a second duration; and the first duration is substantially similar to the second duration.

16. The method of claim 15, wherein the first duration is less than 200 milliseconds and greater than 100 milliseconds.

17. The method of claim 10, wherein determining the estimated RTF is performed by a processor within the hearing assistance device.

18. The method of claim 10, wherein determining the estimated RTF is performed by a processor within a computing device wirelessly connected to the hearing assistance device.

19. The method of claim 18, further including:

generating a voice activity detection input based on a Voice Activity Detector (VAD); and wherein determining the estimated RTF is further based on the voice activity detection input.

20. The method of claim 10, wherein determining a noise reference signal based on the cancellation of the target signal includes cancelling the target signal based a blocking matrix of an adaptive Generalized Sidelobe Canceler, the blocking matrix designed using the RTF.

* * * * *